US005345641A

United States Patent [19]

Webster

[11] Patent Number: 5,345,641

[45] Date of Patent: Sep. 13, 1994

[54] PORTABLE FOOTWEAR CLEANER

[76] Inventor: Noel E. Webster, 4811 Alhambra Ave., Martinez, Calif. 94553

[21] Appl. No.: 974,254

[22] Filed: Nov. 30, 1992

[51] Int. Cl.[5] ..... A47L 23/26

[52] U.S. Cl. ..... 15/105; 15/160; 15/161; 223/114

[58] Field of Search ..... 15/104, 92, 105, 161, 15/160; 223/114–117

[56] References Cited

U.S. PATENT DOCUMENTS

| | | | |
|---|---|---|---|
| 410,829 | 9/1889 | Farley | 223/114 |
| 2,210,365 | 8/1940 | Gilpin | 15/161 |
| 2,602,724 | 7/1952 | Batchelor | 15/104.92 |
| 2,725,167 | 11/1955 | Barnes | 15/105 |
| 2,744,276 | 5/1956 | Chambliss | 15/104.92 |
| 2,876,942 | 3/1959 | Johnson | 223/114 |
| 2,883,097 | 4/1959 | Scardamalia | 15/105 |
| 4,617,917 | 10/1986 | Miller | 15/104.92 |
| 4,866,805 | 9/1989 | Oden | 15/104.92 |
| 5,133,488 | 7/1992 | Peterson | 223/114 |

FOREIGN PATENT DOCUMENTS

| | | | |
|---|---|---|---|
| 710766 | 8/1941 | Fed. Rep. of Germany | 223/114 |
| 1503844 | 5/1969 | Fed. Rep. of Germany | 15/161 |
| 67940 | 3/1943 | Norway | 223/114 |
| 158500 | 11/1992 | Switzerland | 15/161 |

*Primary Examiner*—Timothy F. Simone
*Assistant Examiner*—Terrance R. Till
*Attorney, Agent, or Firm*—Phillips, Moore, Limpio & Finley

[57] ABSTRACT

A device for cleaning soiled footwear with a contoured brush attached to a base section made of flexible carpet or the like, the brush member having one end with affixed bristles pointing upwardly and outwardly for cleaning the instep portions of soiled footwear and having an opposite end comprising an integrally formed U-shaped recessed opening with an overhanging lip used as a boot-jack or footwear remover, allowing the user to clean and remove soiled shoes or boots and change into different footwear and providing the user with a flat, clean surface upon which to stand during this operation.

9 Claims, 5 Drawing Sheets

FIGURE 7
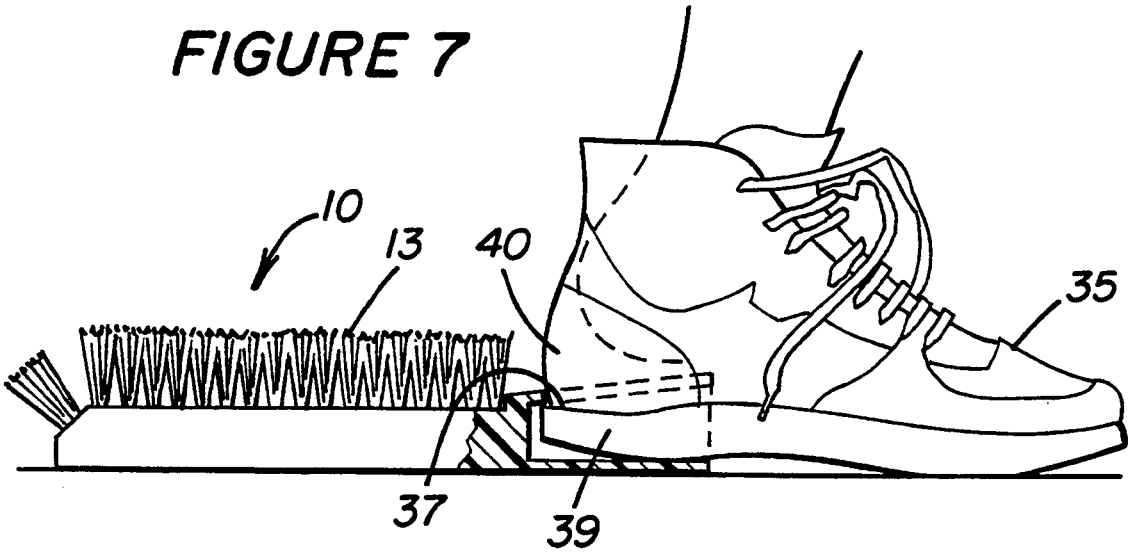
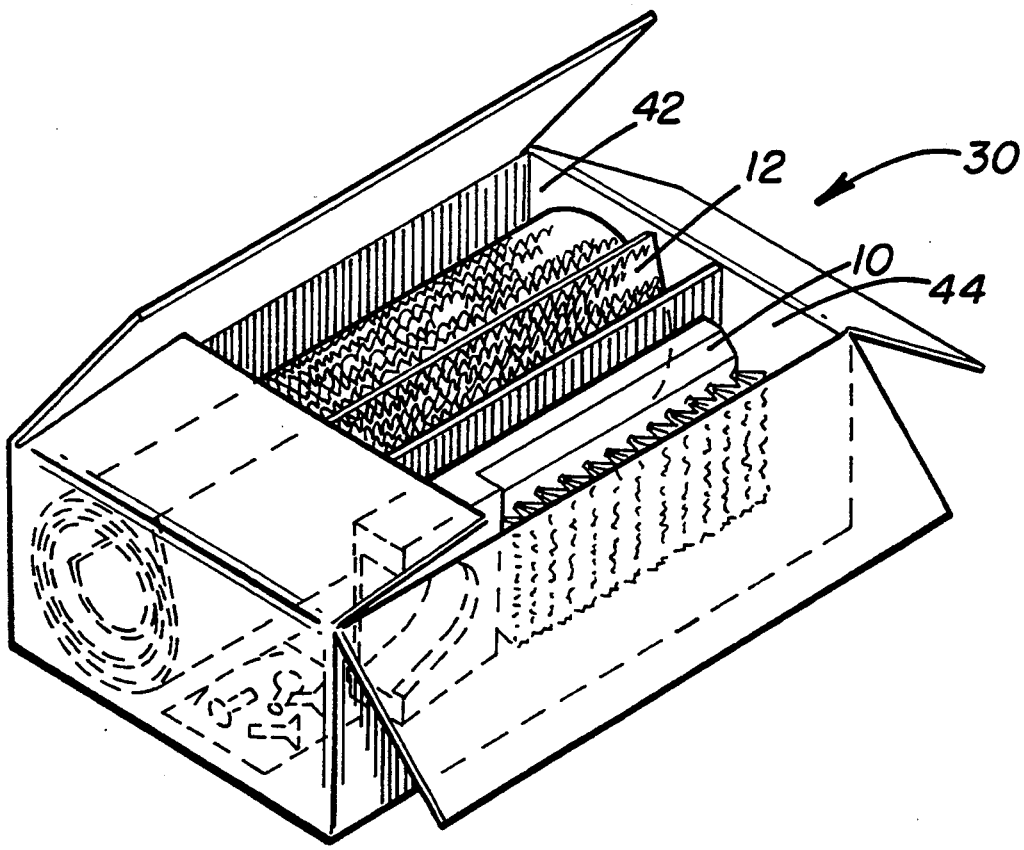
FIGURE 8

PORTABLE FOOTWEAR CLEANER

BACKGROUND OF THE INVENTION

The present invention relates to a portable apparatus which provides a means for cleaning soiled footwear and also for changing shoes or boots in a cleaner and more comfortable manner than previously possible.

Numerous types of sporting or working activities take place in environments in which dust, dirt, mud, snow or ice becomes stuck to the bottoms and sides of shoes or boots. Inevitably it becomes desirable to clean the bottoms and sides of shoes and boots before entering cars, homes, etc.

It is also desirable to provide a portable boot scraper or other type of instep cleaner. The instep is an area of footwear in which mud or other debris is prone to accumulate as it is essentially a wedge shaped cavity on the bottoms of footwear where the heel section would be affixed to the sole portion. Typically, outside of homes or buildings one might encounter a boot scrape permanently mounted in the ground or sidewalk. However, it is desirable to provide a portable scraper or other method for cleaning the instep sections of soiled footwear.

A common problem which has always existed is that during the operation of changing shoes or boots it is always necessary to have a clean place to stand or sit in order to protect the use's foot itself from becoming soiled. This problem might exist, for example, after sporting events such as golf where it would be desirable to clean one's shoes and possibly change them in the parking lot of a golf course before entering the car or clubhouse. A brush alone might solve the problem of dirty shoes but it would not assist the user in changing his or her shoes.

This invention is designed to provide a means whereby soiled shoes or boots (footwear) can be cleaned immediately after use. Additionally, the user can utilize the invention for changing his or her shoes conveniently and comfortably, while wearing socks or stockings or in bare feet, and putting on a new pair of shoes.

Therefore, it is an object of this invention to provide a portable shoe cleaning assembly which would allow the user to clean the bottom portions and the side portions and instep portions of soiled sport or work shoes.

It is also an object of this invention to provide a means for removing soiled shoes or boots while standing in a parking lot or outside of a car or the like.

It is also an object of this invention to provide the user with a clean and comfortable surface upon which to stand during the operation of cleaning and changing soiled shoes or boots.

It is a further object of this invention to describe a method for cleaning mud, dirt, snow and the like from sport or work shoes or boots or the like.

SUMMARY OF THE INVENTION

This invention is a portable footwear cleaning and removing device which is composed of a base member made of flexible carpet, rug, or similar material to which is attached a contoured brush member with bristles affixed for cleaning soiled footwear and with a footwear remover integrally formed at one end of the brush member. The base member is meant to provide a clean, comfortable, and safe place to stand during the cleaning and removal of soiled footwear which is impervious to water and can be cleaned easily. The bristles of the brush member are mounted in such a configuration as to allow cleaning of the bottom and side portions of footwear as well as the instep sections and are meant to be suitable for cleaning leather or synthetic materials of shoe and boot construction without damaging the footwear. The brush member can be detachably mounted onto the base member so as to provide an assembly, which when disassembled, can be stored and transported easily.

This invention also provides a convenient storage system for the portable footwear cleaning device.

BRIEF DESCRIPTION OF THE DRAWINGS

FIG. 7 is a view of the operation of the footwear remover affixed to the portable shoe cleaning device.

FIG. 8 is a view of the storage container designed for storage and transportation of the invention.

DETAILED DESCRIPTIONS OF THE PREFERRED EMBODIMENTS

Referring particularly to the drawings, like numerals designate like parts.

Figure 1:
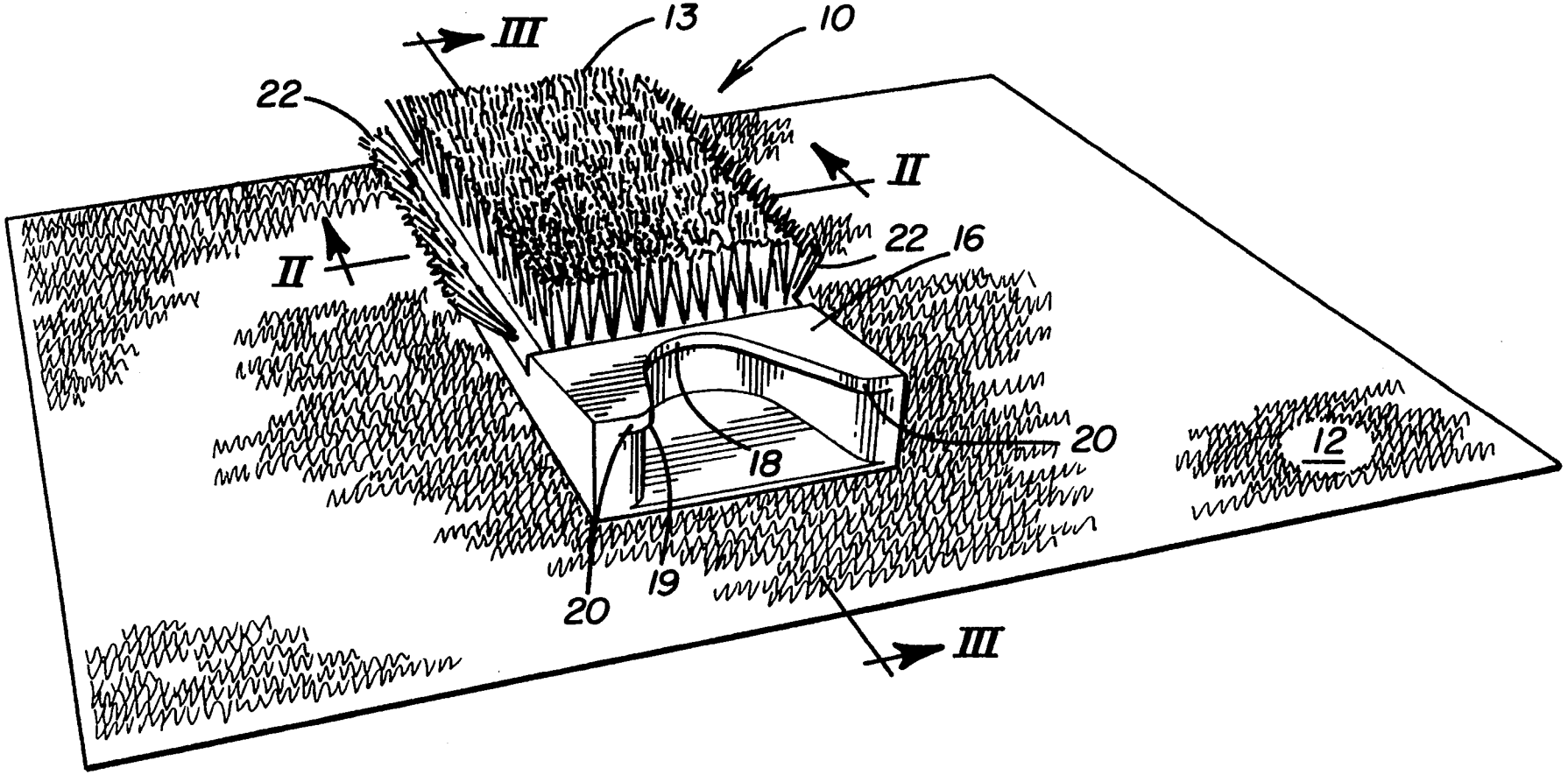
FIG. 1 is an isometric view of the preferred embodiment of the portable shoe cleaning device of this invention.

FIG. 1 shows one embodiment of the invention. A brush member 10 is affixed to a base member 12. Bristles 13 extend upwardly from the top surface 21 of the brush member. These bristles serve to clean the bottom portions of footwear placed upon the bristles and rubbed back and forth by the user wearing the footwear.

A footwear remover 16 is mounted on one end of the brush member and is comprised of a recessed U-shaped opening 18 at the front of the brush member. This opening 18 is shaped to receive the heel portion of footwear to be removed by the user. The two arms 20 of the opening extend outward and slightly upward to guide the footwear into place. Around the top surface of the footwear remover there is an integrally formed lip section 19. This lip extends slightly outward around the rim along the inside of the U-shaped surface and along the insides of the extending guide arms. This lip is designed to engage footwear at the juncture between the heel section of the sole in the back of the shoe and the body or upper of the footwear (inserted into the footwear remover).

The base member 12 is a piece of heavy carpet or rug material. It is preferably composed of synthetic materials such as polyester so as to be washable and durable. The bottom side which rests upon the ground when the invention is in use is coated with some type of material such as plastic, rubber or the like so as to provide impermeability by water, rain, mud or the like.

The bristles 13 affixed to the brush member 10 are made of natural or synthetic fiber which is soft enough to prevent unwanted scuffing or scratching of synthetic or leather footwear material of construction. Additionally the fibers comprising the bristles are stiff enough to provide effective means for removing mud or other outdoor-type debris adhering to shoes or boots.

The brush member 10 is detachably affixed to the base member 12 by any means which would provide a secure connection between the two members and still allow the brush member to be removed. Preferably the brush 10 is affixed by a plurality of screws 25. Screws 25 pass through appropriately placed grommets 27 placed in base member 12. The grommets 27 serve to anchor the brush 10 to the surface 12. This connection could also be snaps, hooks or the like at one end of the brush member or at two ends of the brush member or on two sides of the brush member.

Figure 2:
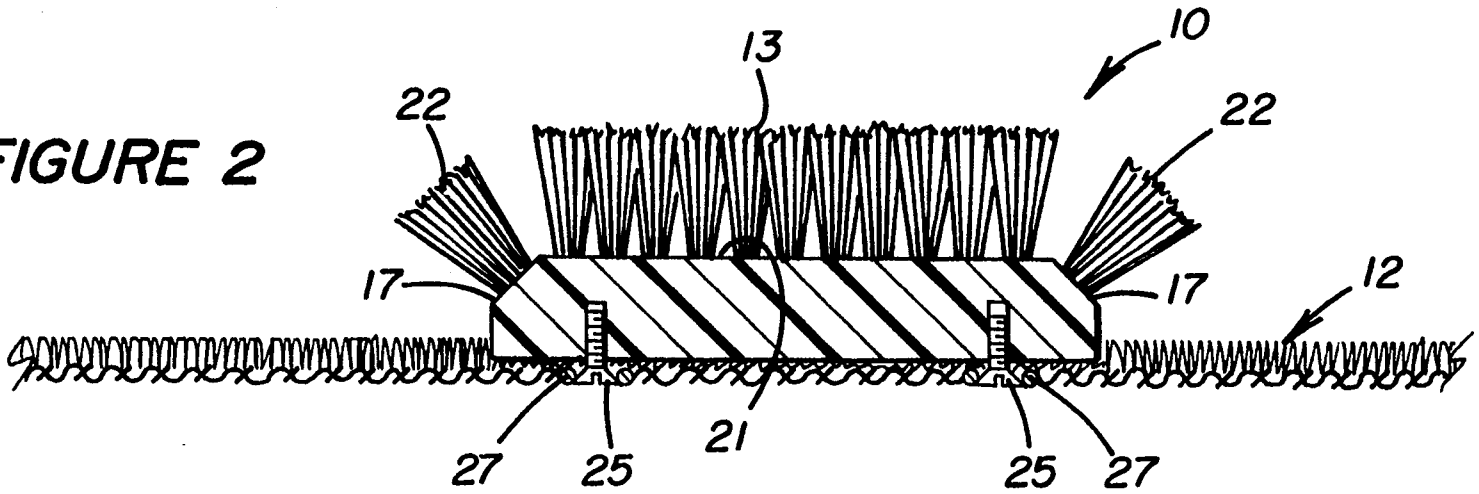
FIG. 2 is a cross-sectional at section line II—II of the device shown in FIG. 1.

FIG. 2 shows cross-sectional view II—II of the invention. Upon the top portion of the brush member, bevelled edges 17 between the top and side surfaces provide two longitudinal surfaces upon which additional bristles 22 are affixed extending upwardly and outwardly from the brush member 10. These bristles serve to clean the side portions of soiled footwear placed against the bristles and rubbed back and forth by the user wearing the footwear. These bristles serve to clean, in particular, the seam generally found between the sole portion and the body portion of shoes and boots.

Figure 3:
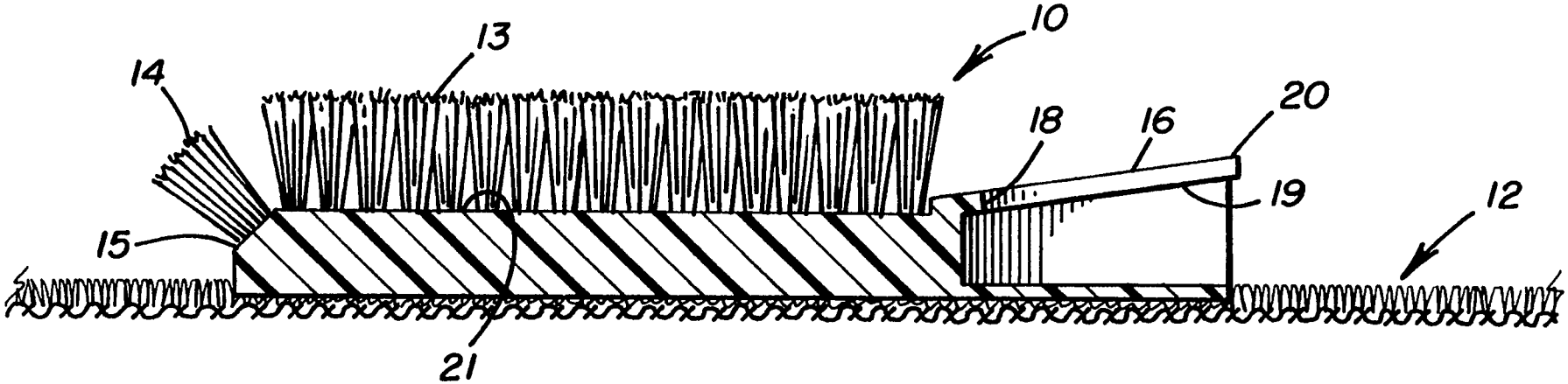
FIG. 3 is a cross-sectional at section line III—III of the device shown in FIG. 1.

FIG. 3 shows cross-sectional view III—III of the invention. At one end instep cleaning bristles 14 are attached. These bristles are mounted on a bevelled edge surface 18 between the top surface of the brush member and the front end of the brush member and extend upwardly and outwardly. These bristles serve particularly for cleaning the instep portions of shoes or boots. The user extending his or her foot wearing the soiled shoe or boot can brush the mud or debris out of the cavity near the instep portion of shoes and boots using these bristles.

Figure 4:
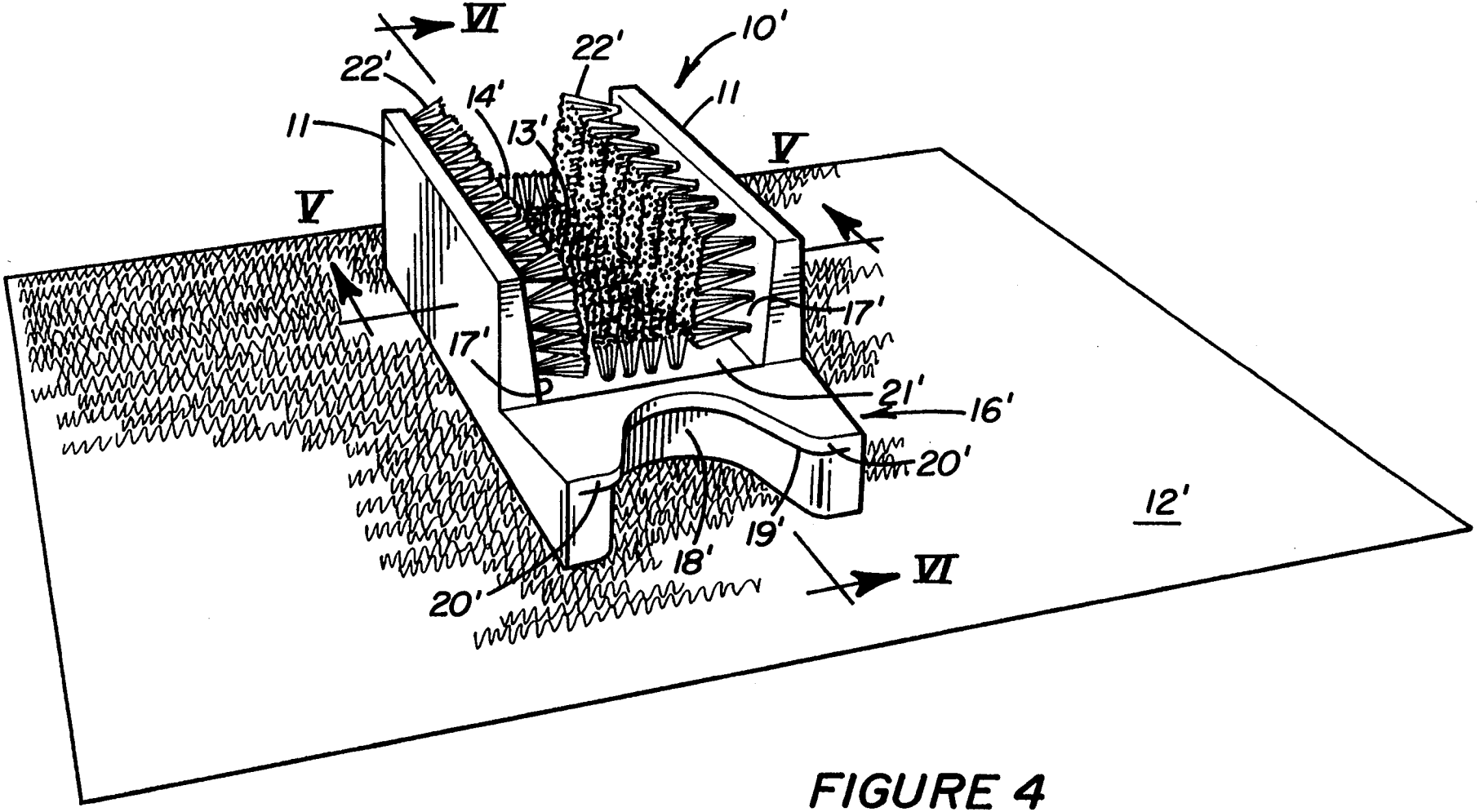
FIG. 4 is an isometric view of another embodiment of the portable shoe cleaning device of this invention.
Figure 5:
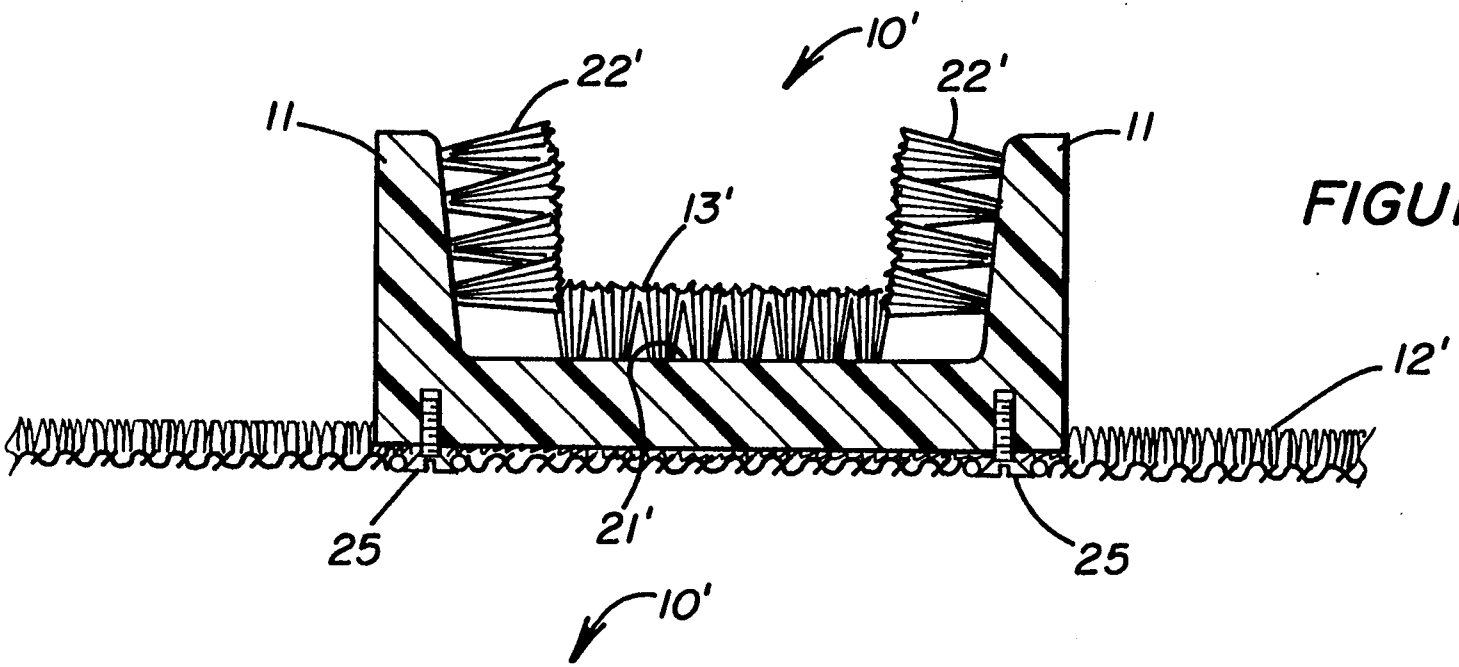
FIG. 5 is a cross-sectional at section line V—V of the device shown in FIG. 4.
Figure 6:
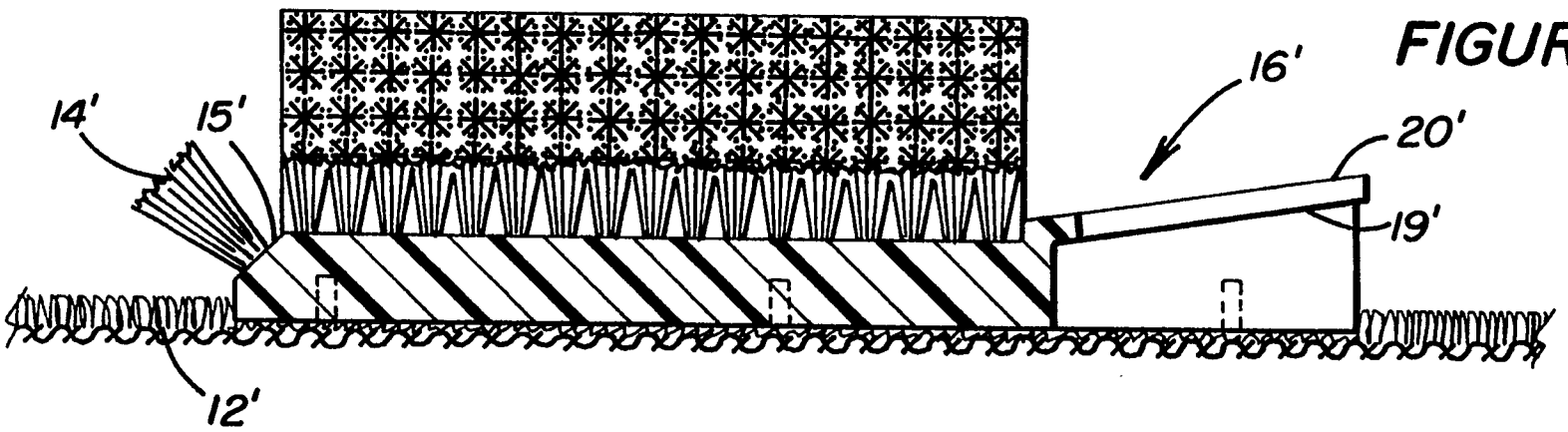
FIG. 6 is a cross-sectional at section line IV—IV of the device shown in FIG. 4.

FIGS. 4, 5 and 6 show another embodiment of the invention. The brush member 10' is affixed to the base member 12' in the same manner as in the preferred embodiment and has two parallel upstanding wall structures 11 on either side of a central flat rectangular surface 21'. Bristles 13' are affixed to the central flat surface 21' and extend upwardly. Bristles 22' are also affixed to the inside rectangular surfaces 17' of the parallel wall structures and point inwardly and towards each other on either side. On one end of the brush member there are instep cleaning bristles 14' which are affixed to the bevelled edge surface 18' between the central flat rectangular surface and the front end of the brush member. At the opposite end of the brush member is footwear remover 16' comprised of a recessed U-shaped opening 18 shaped to receive the heel portion of footwear to be removed by the user. The two arms 20' of the opening extend outward and slightly upward to guide the footwear into place. Around the top surface of the footwear remover there is an integrally formed lip section 19'. This lip extends slightly outward around the rim along the inside of the U-shaped surface and along the insides of the extending guide arms. This lip is designed to engage footwear at the juncture between the sole section of the heel in the back of the shoe and the body of the footwear (inserted into the footwear remover).

The operation of the footwear remover of the invention is shown in FIG. 7. As described above, the integrally formed lip engages footwear 35 at the juncture 37 of the heel section 39 of the sole and the body 40 of the shoe. As the user pulls up with his or her foot, the device prevents the footwear from remaining on the foot and the foot comes out of the footwear.

As shown in FIG. 8, the storage container 30 for the device has two compartments. When the base member is detached from the brush member, the base member can be rolled up and placed in one section 42 of the container while the brush member can be placed next to the base member in the second section 44 of the container.

I claim:

1. A portable footwear cleaning and removing device which comprises:

a base member large enough for an adult human being to stand on with both feet;

an elongated brush member affixed to said base member, said brush member having bristles affixed thereto;

footwear remover means at one end of the brush member; and wherein the body of said elongated brush member defines a longitudinal axis and is flat on top with bevelled top edge faces along the longitudinal axis of said brush member with said bristles being mounted on said top and said bevelled top edge faces.

2. The apparatus of claim 1 wherein the brush member defines a top bevelled end surface distal to the footwear remover means, and wherein a first portion of the bristles affixed to the brush member are mounted pointing in an upward direction and a second portion of the bristles affixed to the brush member are mounted along the bevelled top edges pointing upward and outward.

3. The apparatus of claim 2 further having an instep cleaner wherein a third portion of the bristles affixed to the brush member are affixed to the top bevelled end surface at the end of the brush member distal to the footwear remover means.

4. The apparatus of claim 3 wherein the footwear remover means includes:

an integrally formed recessed opening, formed to receive the heel portion of footwear to be removed; and an integrally formed lip on the top inner side of said recessed opening extending horizontally a relatively small distance from the recessed opening.

5. The apparatus of claim 4 wherein the base member comprises a rectangular section of flexible material.

6. The apparatus of claim 5 further including container means for storage or transport of the apparatus wherein the base member and the brush member are separable, allowing the base member to be rolled and inserted into one portion of the container means, and the brush member to be placed into a second portion of the container means.

7. A portable footwear cleaning and removing device which comprises:

a base member large enough for an adult human being to stand on with both feet;

an elongated brush member affixed to said base member, said brush member having bristles affixed thereto, wherein the body of said brush member comprises a central flat surface parallel to the base member with two parallel wall structures perpendicular to the base member, and a top bevelled end surface at one end of said brush member and further wherein the bristles of said brush member extend inwardly from the inside surfaces of said wall structures and upwardly from the central flat surface;

footwear remover means at one end of the brush member; and a top bevelled end surface at one end of said brush member;

an instep cleaner having bristles affixed to the top bevelled end surface, said bristles pointing upwardly and outwardly.

8. The apparatus of claim 7 wherein the footwear remover means includes:

an integrally formed recessed opening, comprising two outwardly extending arms shaped to received the heel portion of footwear to be removed; and an integrally formed lip on the top side of said recessed opening extending horizontally a relatively small distance from the recessed opening.

9. The apparatus of claim 8 wherein the base member comprises flexible carpet, rug material.

* * * * *